US011579541B2

(12) United States Patent
Yuasa et al.

(10) Patent No.: US 11,579,541 B2
(45) Date of Patent: Feb. 14, 2023

(54) IMAGE FORMING APPARATUS INCLUDING A ROLLSHAPED CHARGE UNIT FOR SECONDARY TRANSFER BODY

(71) Applicant: FUJIFILM Business Innovation Corp., Tokyo (JP)

(72) Inventors: Koichiro Yuasa, Ebina (JP); Toshiaki Baba, Ebina (JP); Yoko Miyamoto, Ebina (JP); Takeshi Yasuda, Ebina (JP); Hirotaka Tanaka, Ebina (JP); Masaaki Takahashi, Ebina (JP); Tomoaki Yoshioka, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/356,967

(22) Filed: Jun. 24, 2021

(65) Prior Publication Data

US 2021/0318634 A1 Oct. 14, 2021

Related U.S. Application Data

(63) Continuation of application No. PCT/JP2019/028685, filed on Jul. 22, 2019.

(30) Foreign Application Priority Data

Mar. 8, 2019 (JP) ..... JP2019-042977

(51) Int. Cl.

| | |
|---|---|
| ***G03G 15/02*** | (2006.01) |
| ***G03G 15/00*** | (2006.01) |
| ***G03G 21/20*** | (2006.01) |
| ***G03G 15/20*** | (2006.01) |

(52) U.S. Cl.

CPC ..... *G03G 15/0266* (2013.01); *G03G 15/5037* (2013.01); *G03G 15/6555* (2013.01);
(Continued)

(58) Field of Classification Search

CPC ... G03G 15/1605; G03G 15/1675; B65H 5/12
See application file for complete search history.

(56) References Cited

U.S. PATENT DOCUMENTS

| | | | |
|---|---|---|---|
| 5,502,545 | A | 3/1996 | Tsuruoka |
| 5,655,208 | A | 8/1997 | Sahay et al. |

(Continued)

FOREIGN PATENT DOCUMENTS

| | | | |
|---|---|---|---|
| JP | H07-309479 | A | 11/1995 |
| JP | H10-010831 | A | 1/1998 |

(Continued)

OTHER PUBLICATIONS

Oct. 1, 2019 International Search Report issued in International Patent Application No. PCT/JP2019/028685.

(Continued)

*Primary Examiner* — Arlene Heredia
(74) *Attorney, Agent, or Firm* — Oliff PLC

(57) ABSTRACT

An image forming apparatus includes: an image holder configured to hold an image formed using an electrographic process; a transfer body that faces the image holder and is configured to contact the image holder while rotating to form a secondary transfer region; an application unit configured to apply a voltage for charging the secondary transfer region; and a charge unit that faces a region other than the secondary transfer region of the transfer body and is configured to charge a surface of the transfer body with a polarity opposite to an applied voltage of the application unit.

9 Claims, 5 Drawing Sheets

(52) U.S. Cl.
CPC ..... *G03G 21/203* (2013.01); *G03G 15/2003* (2013.01); *G03G 15/5054* (2013.01)

(56) References Cited

U.S. PATENT DOCUMENTS

| | | | | |
|---|---|---|---|---|
| 8,843,039 | B2 * | 9/2014 | Namba | G03G 15/162 399/313 |
| 2010/0142982 | A1 | 6/2010 | Moore et al. | |
| 2010/0278550 | A1 * | 11/2010 | Chiba | G03G 15/1605 399/66 |
| 2011/0177449 | A1 | 7/2011 | Tanaka et al. | |
| 2013/0164011 | A1 * | 6/2013 | Nakamura | G03G 15/1675 399/66 |
| 2020/0209786 | A1 * | 7/2020 | Kato | G03G 15/553 |

FOREIGN PATENT DOCUMENTS

| | | | |
|---|---|---|---|
| JP | 3282373 | B2 | 5/2002 |
| JP | 2003-015484 | A | 1/2003 |
| JP | 2005-315987 | A | 11/2005 |
| JP | 2011-145592 | A | 7/2011 |
| JP | 2012-032573 | A | 2/2012 |
| JP | 2013-107761 | A | 6/2013 |

OTHER PUBLICATIONS

Oct. 1, 2019 Written Opinion issued in International Patent Application No. PCT/JP2019/028685.
Oct. 18, 2022 Office Action issued in Japanese Patent Application No. 2019-042977.

* cited by examiner

IMAGE FORMING APPARATUS INCLUDING A ROLLSHAPED CHARGE UNIT FOR SECONDARY TRANSFER BODY

CROSS REFERENCE TO RELATED APPLICATIONS

This is a continuation of International Application No. PCT/JP2019/028685 filed on Jul. 22, 2019, and claims priority from Japanese Patent Application No. 2019-042977 filed on Mar. 8, 2019.

BACKGROUND

Technical Field

The present disclosure relates to an image forming apparatus.

Related Art

An image forming apparatus described in Patent Literature 1 is an image forming apparatus that holds a sheet on a transfer belt and transfers a toner image from multiple photosensitive drums by discharge of a transfer corotron to create a full-color copy. The image forming apparatus has a configuration in which a charging corotron is disposed on the transfer belt to hold the sheet and the sheet is peeled using a peeling corotron at a peeling position.

CITATION LIST

Patent Literature

Patent Literature 1: JP-A-7-309479

SUMMARY

Aspects of non-limiting embodiments of the present disclosure relate to provide an image forming apparatus capable of preventing sheet wrinkles in a secondary transfer unit as compared with a configuration in which a transfer body constituting a secondary transfer unit is used without being charged in advance.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus according to a first aspect of the present disclosure includes: an image holder configured to hold an image formed using an electrographic process; a transfer body that faces the image holder and is configured to contact the image holder while rotating to form a secondary transfer region; an application unit configured to apply a voltage for charging the secondary transfer region; and a charge unit that faces a region other than the secondary transfer region of the transfer body and is configured to charge a surface of the transfer body with a polarity opposite to an applied voltage of the application unit.

BRIEF DESCRIPTION OF DRAWINGS

Exemplary embodiment(s) of the present invention will be described in detail based on the following figures, wherein.

DETAILED DESCRIPTION

First Exemplary Embodiment

Figure 1:
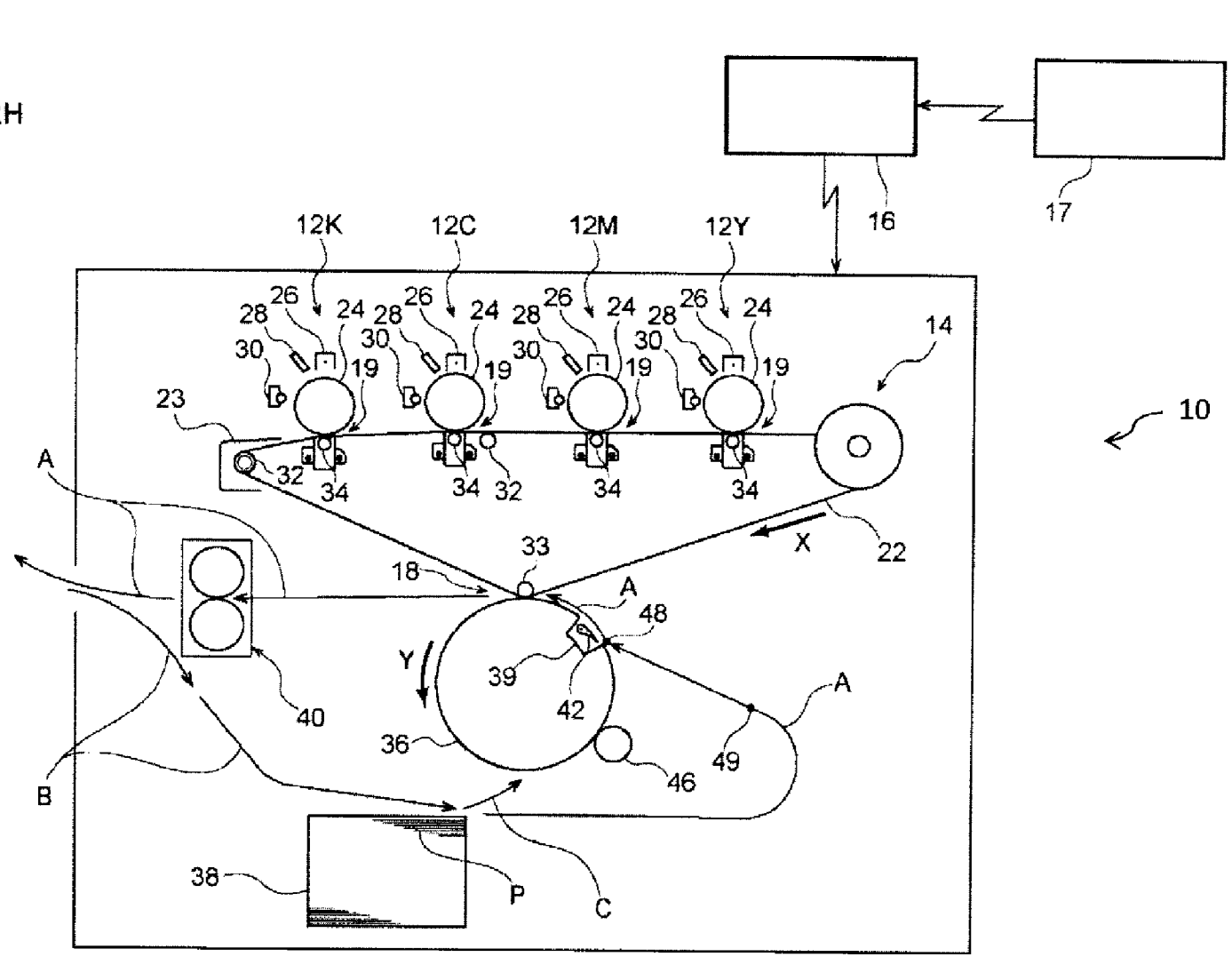
FIG. 1 is a front view showing an image forming apparatus according to a first exemplary embodiment.

An example of an image forming apparatus (hereinafter, simply referred to as an "apparatus") according to a first exemplary embodiment of the present disclosure will be described with reference to FIGS. 1 and 2. An arrow UP shown in each figure is a vertical direction and indicates an upward direction of the apparatus. As shown in FIG. 1, an arrow RH is a horizontal direction and indicates a right side when facing the apparatus. When an upper-lower direction is designated without any premise in the following description, the upper-lower direction means an upper-lower direction of the apparatus shown in FIG. 1. When a left-right direction is designated without any premise in the following description, the left-right direction means left (=L) and right (=R) directions when facing the apparatus shown in FIG. 1. Further, when a depth direction (=a front side and a back side) is designated without any premise in the following description, the depth direction means a depth direction when facing the apparatus shown in FIG. 1.

[Overall Configuration of Image Forming Apparatus 10]

First, a configuration of an image forming apparatus 10 will be described. FIG. 1 is a front view schematically showing the image forming apparatus 10 according to the present exemplary embodiment.

As shown in FIG. 1, the image forming apparatus 10 includes image forming units 12Y, 12M, 12C, and 12K that form an image using an electrographic process, an intermediate transfer belt 22 that holds a formed image, and an intermediate transfer unit 14 that mounts and supports the intermediate transfer belt 22. In the image forming apparatus 10, a transfer body 36 that transfers an image from the intermediate transfer unit 14 to a sheet P (corresponding to an example of an image medium) for image recording is provided below the intermediate transfer unit 14.

A contact portion between the intermediate transfer belt 22 and the transfer body 36 constitutes a secondary transfer unit to be described later. The secondary transfer unit is an example of a secondary transfer region. In the secondary transfer unit, a toner image formed by an image forming unit 12 is transferred to a front surface of the sheet P via the intermediate transfer belt 22 attached to the intermediate transfer unit 14.

The image forming apparatus 10 includes multiple image forming units 12Y, 12M, 12C, and 12K that form toner layers of various colors. In the present exemplary embodiment, a total of four image forming units 12 corresponding to the various colors of the yellow image forming unit 12Y, the magenta image forming unit 12M, the cyan image forming unit 12C, and the black image forming unit 12K are provided.

Here, in the present exemplary embodiment, yellow (=Y), magenta (=M), cyan (=C), and black (=K) are basic colors for outputting a color image. In the following description, when it is not necessary to distinguish the various colors in the image forming units 12, the image forming units 12 are simply referred to as the "image forming unit 12", and symbols of Y, M, C, or K, which mean the image forming units corresponding to the various colors, will be appropriately omitted.

The image forming units 12 of the various colors are basically formed in the same manner except for a toner to be used. As shown in FIG. 1, each image forming unit 12 includes a rotating cylindrical photoconductor 24 and a charger 26 that charges the photoconductor 24. The image forming unit 12 further includes an exposure device 28 that irradiates the charged photoconductor 24 with light for exposure to form an electrostatic latent image and a developing device 30 that develops, with a developer containing a toner, the electrostatic latent image as an image formed by a toner layer.

The photoconductor 24 of each color comes into contact with the intermediate transfer belt 22. As shown in FIG. 1, the image forming units 12 corresponding to yellow, magenta, cyan, and black are disposed side by side from an upstream side in a rotation direction (=a direction of an arrow X in FIG. 1) of the intermediate transfer belt 22.

(Intermediate Transfer Unit 14)

The intermediate transfer unit 14 includes a primary transfer roll 34 that faces the image forming unit 12 of each color, and a backup roll 33 that faces the transfer body 36. The backup roll 33 is an example of an application unit. The transfer body 36 will be described in detail later.

(Intermediate Transfer Belt 22)

As shown in FIG. 1, the intermediate transfer belt 22 is formed in an endless shape. The intermediate transfer belt 22 is an example of the image holder. The intermediate transfer belt 22 is wound around multiple rolls 32 to determine a posture. In the present exemplary embodiment, the posture of the intermediate transfer belt 22 is a substantially obtuse triangular shape that is long in a width direction of the device in a front view and has a convex portion with an obtuse angle in a downward direction. Of the multiple rolls 32, one roll (not shown) has a function of rotating the intermediate transfer belt 22 in the direction of the arrow X by a power of a motor (not shown). The intermediate transfer belt 22 rotates in the direction of the arrow X to transport a primarily transferred image to a secondary transfer unit 18 to be described later.

The intermediate transfer belt 22 is rotatable in the direction of the arrow X in a state in which the intermediate transfer belt 22 is in contact with or separated from the photoconductor 24 of each color.

(Primary Transfer Unit)

As shown in FIG. 1, the primary transfer unit 19 includes a contact portion between the photoconductor 24 and the intermediate transfer belt 22, and the primary transfer roll 34. The primary transfer roll 34 faces the photoconductor 24 with the intermediate transfer belt 22 interposed between the primary transfer roll 34 and the photoconductor 24. The primary transfer roll 34 and the intermediate transfer belt 22 are in contact with each other at a predetermined load.

A voltage is applied to the primary transfer roll 34 by a power supply unit (not shown). This voltage is a primary transfer voltage for primarily transferring a toner image formed on the photoconductor 24 to the intermediate transfer belt 22 between the photoconductor 24 and the primary transfer roll 34.

(Secondary Transfer Unit)

As shown in FIG. 1, the secondary transfer unit 18 (corresponding to an example of the secondary transfer region) is constituted by a contact portion between the intermediate transfer belt 22 and the transfer body 36 formed in a roll shape. The intermediate transfer belt 22 is in contact with the transfer body 36 at a predetermined load by the backup roll 33 that faces the transfer body 36. Details of the transfer body 36 will be described later.

A voltage is applied to the transfer body 36 by the power supply unit (not shown). This voltage is a secondary transfer voltage when the toner image superposedly transferred to the intermediate transfer belt 22 is secondarily transferred to the sheet P transported to the secondary transfer unit 18.

(Fixing Device)

A fixing device 40 is disposed downstream of the secondary transfer unit 18 in a transport direction of the sheet P. The fixing device 40 includes a pair of facing rolls. The pair of rolls face each other across a sheet transport path A. That is, the sheet P to be fixed is transported so as to pass between the pair of rolls.

(Sheet Transport Path)

The sheet transport path A shown in FIG. 1 (hereinafter, appropriately referred to as a "transport path") has a function of transporting the sheet P prepared in advance in a sheet tray 38. More specifically, the transport path A includes multiple rolls (not shown) for transporting a sheet. Accordingly, the sheet P is transported along the transport path A so as to sequentially pass through the secondary transfer unit 18 and the fixing device 40.

(Image Forming Operation of Basic Image)

Next, an outline of a basic image forming operation on the sheet P in the image forming apparatus 10 will be described.

Upon receiving an image forming command from the outside, a control unit 16 operates each image forming unit 12. The photoconductor 24 of each color is charged by the charger 26 while rotating. The control unit 16 sends image data subjected to image processing in an image signal processing unit (not shown) to each exposure device 28. The exposure device 28 irradiates each photoconductor 24 with exposure light in accordance with the image data, thereby exposing each charged photoconductor 24. Accordingly, an electrostatic latent image is formed on an outer peripheral surface of each photoconductor 24. The electrostatic latent image formed on the photoconductor 24 is developed by each developing device 30, and a toner image of each color is formed on the photoconductor 24 corresponding to each color.

The toner image of each color formed on the photoconductor 24 of each color is primarily transferred to the intermediate transfer belt 22 by the primary transfer roll 34 of each color in each primary transfer unit. In this case, by rotating the intermediate transfer belt 22, the toner image of each color is sequentially primarily transferred to the intermediate transfer belt 22 while being superimposed. The toner image superimposed in this way is transported to the secondary transfer unit by rotation of the intermediate transfer belt 22. Then, the superimposed toner image is transferred from the intermediate transfer belt 22 to the sheet P in the secondary transfer unit.

The sheet P on which the toner image is secondarily transferred is transported toward the fixing device 40. In the fixing device 40, a toner image forming surface (hereinafter, appropriately referred to as a "front surface") of the sheet P is heated and pressed by a fixing belt, and a surface (hereinafter, appropriately referred to as a "back surface") of the sheet P on a back side with respect to the toner image forming surface is heated and pressed by a fixing roll. Accordingly, the toner image formed by the each image forming unit 12 is fixed to the sheet P.

When images are formed on both surfaces of the sheet P, front and back surfaces of the sheet P having passed through the fixing device 40 are reversed in a subsequent transport path. Thereafter, the sheet P is transported along a transport path B including multiple rollers (not shown) and is transported to the transport path A again.

[Configurations]

Next, configurations of the present exemplary embodiment will be described.

(Transfer Body)

As shown in FIG. 1, the transfer body 36 faces the backup roll 33 with the intermediate transfer belt 22 interposed between the transfer body 36 and the backup roll 33. The transfer body 36 has a cylindrical shape whose axial direction is a depth direction of the image forming apparatus 10, and is rotatable about the axial direction (=a direction of an arrow Y). Here, a recess 39 in which a gripper 42 to be described later is accommodated is formed on an outer periphery of the transfer body 36. The perimeter of the transfer body 36 excluding the recess 39 is longer than a maximum length of an image formation target sheet in the image forming apparatus 10 in the transport direction. The maximum length of the image formation target sheet in the transport direction is determined by a specification of the apparatus.

(Gripper)

The image forming apparatus 10 includes a gripper 42 that holds a leading end portion of a sheet to be transported and assists transport of the sheet. The gripper 42 holds a leading end portion of the sheet in the depth direction of the apparatus.

The gripper 42 is configured to rotate along a predetermined rotation path D while being held by a transport chain (not shown) provided on a front side and a back side of the image forming apparatus 10.

Figure 2:
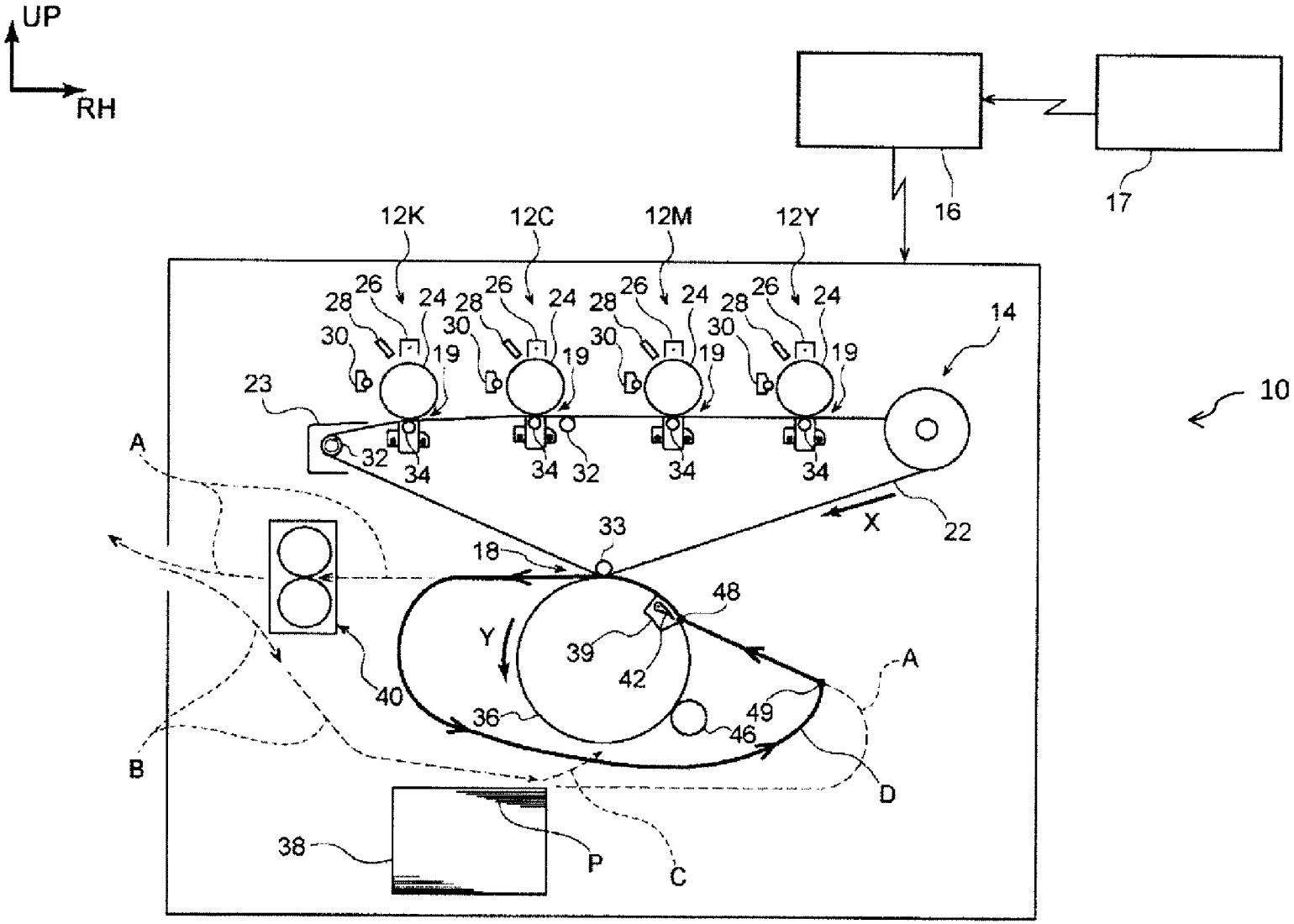
FIG. 2 is a side view showing a rotation path of a gripper in the image forming apparatus according to the first exemplary embodiment.

Here, as shown in FIG. 2, the rotation path D partially overlaps the sheet transport path A in a front view of the image forming apparatus 10. More specifically, the rotation path D moves along the outer periphery of the transfer body 36 between the secondary transfer unit 18 and a holding point 48. The holding point 48 is provided upstream of the secondary transfer unit 18 in the transfer body 36 and downstream of a charge unit 46 to be described later.

The rotation path D is configured to pass through a gripping point 49 provided upstream of the transfer body 36 in the transport path A of the sheet P. Here, the gripping point 49 referred to here is a position at which gripping of the sheet P is started by the gripper 42. In the present exemplary embodiment, the gripping point 49 is provided upstream of the holding point 48 in a sheet transport direction. At the holding point 48, holding of the sheet P is started by the gripper 42 and the transfer body 36. Further, the rotation path D avoids a contact portion between the transfer body 36 and the charge unit 46.

Here, an operation of the gripper 42 will be described. The gripper 42 starts holding the leading end portion of the sheet P to be transported at the gripping point 49 while rotating at a speed corresponding to a transport speed of the sheet P along the rotation path D. Thereafter, the gripper 42 rotates along the sheet transport path A and holds the leading end portion of the sheet P on an outer peripheral surface of the transfer body 36 at the holding point 48. In this case, the gripper 42 rotates in accordance with rotation of the transfer body 36 while being accommodated in the recess 39 formed on the outer periphery of the transfer body 36. Accordingly, the sheet P whose leading end is held by the gripper 42 is also transported on the outer peripheral surface of the transfer body 36.

Further, after passing through the secondary transfer unit 18, the gripper 42 releases gripping of a leading end of the sheet P. Thereafter, the gripper 42 rotates in the rotation path D independent of the sheet transport path A and is returned to the gripping point 49 again.

(Charge Unit)

As shown in FIG. 1, a roll-shaped charge unit 46 is provided upstream of the secondary transfer unit 18 on the outer peripheral surface of the transfer body 36 and faces the secondary transfer unit 18. The charge unit 46 is provided in contact with the transfer body 36, and is configured to rotate in accordance with the rotation of the transfer body 36.

A voltage is applied to a surface of the charge unit 46, and the surface of the charge unit 46 is charged. Here, application of a voltage to the charge unit 46 is controlled so that a voltage applied to the transfer body 36 is constant (constant voltage control). More specifically, the voltage applied to the transfer body 36 by the charge unit 46 is a voltage having a polarity opposite to a secondary transfer voltage applied to the intermediate transfer belt 22 in the backup roll 33 (=application unit) of the secondary transfer unit. Therefore, the surface of the transfer body 36 charged by the application of the voltage from the charge unit 46 assists formation of a transfer electric field in the secondary transfer unit 18. That is, in the secondary transfer unit 18, a voltage value applied from the backup roll 33 to the intermediate transfer belt 22 is set to be small.

The image forming apparatus 10 may form a toner image not intended to be transferred to the sheet P on the intermediate transfer belt 22 by the image forming unit 12. For example, a case of forming an image for adjusting a density, a hue, or a printing position, a case of forming a toner image for a purpose of supplying a toner as a lubricant in order to improve a lubricity of each member, a case of forming a toner image in order to discharge a deteriorated toner to an outside of the apparatus, and the like correspond to the above case. In this case, the toner image formed on the intermediate transfer belt 22 is collected by a cleaner 23 provided downstream of the secondary transfer unit 18 along with the rotation of the intermediate transfer belt 22.

At this time, in the secondary transfer unit 18, the toner image comes into contact with the transfer body 36, but in order to prevent transfer of the toner image to the transfer body 36, the backup roll 33 applies a voltage having an absolute value smaller than that during normal printing (hereinafter, referred to as a "normal state") in which the toner image is transferred from the intermediate transfer belt 22. As for a voltage applied by the charge unit 46 to a corresponding region of the transfer body 36, a voltage having an absolute value smaller than that in the normal state is applied for the same purpose.

Further, at this time, a position of a leading end portion of a region on the outer peripheral surface of the transfer body 36 in which an absolute value of a voltage applied by the charge unit 46 is set to be smaller than normal is shifted in a circumferential direction of the transfer body 36 as compared with a position of a leading end portion of a region in which an absolute value of a voltage applied to the intermediate transfer belt 22 by the backup roll 33 is set to be smaller than that in the normal state.

According to such a configuration, as compared with a case in which the region on the intermediate transfer belt 22 and the region on the transfer body 36 have the same size on the outer peripheral surface of the transfer body 36, the region on the intermediate transfer belt 22 to which the voltage having the absolute value smaller than that in the normal state is applied by the backup roll 33 or the charge unit 46 may be increased on the outer peripheral surface of the transfer body 36. The voltage having an absolute value smaller than that in the normal state is applied to the region on the intermediate transfer belt 22 by the backup roll 33. The voltage having an absolute value smaller than that in the normal state is applied to the region on the transfer body 36 by the charge unit 46.

More specifically, the region on the outer peripheral surface of the transfer body 36 in which the absolute value of the voltage applied by the charge unit 46 is set to be smaller than that in the normal state is set to be wider in the circumferential direction of the transfer body 36 as compared with the region in which the absolute value of the voltage applied to the intermediate transfer belt 22 by the backup roll 33 is set to be smaller than that in the normal state.

According to such a configuration, it is possible to prevent the discharge generated between the surface of the transfer body 36 and the intermediate transfer belt 22 as compared with a configuration in which the region on the outer peripheral surface of the transfer body 36 is set to be narrower in the circumferential direction of the transfer body 36 as compared with the region in the intermediate transfer belt 22. In the region on the outer peripheral surface of the transfer body 36, the absolute value of the voltage is set to be smaller than that in the normal state. In the region in the intermediate transfer belt 22, the absolute value of the voltage applied by the backup roll 33 is set to be smaller than that in the normal state.

When an operation (=corresponding to an example of a normal operation) of forming a toner image intended to be transferred to the sheet P is shifted to an operation of forming a toner image not intended to be transferred to the sheet P, the transfer body 36 is driven for one round in a state in which a voltage is not applied to the transfer body 36 by the charge unit 46. Accordingly, a history of a surface potential on the outer peripheral surface of the transfer body 36 may be erased.

(Sensor)

As shown in FIG. 1, the image forming apparatus 10 is provided with multiple sensors 17. These sensors 17 are configured to detect humidity or temperature of a usage environment of the image forming apparatus 10. Information detected by these sensors 17 is acquired by the control unit 16. Based on the information, the voltage applied from the backup roll 33 in the secondary transfer unit 18 and the voltage applied in the charge unit 46 are determined by the control unit 16.

<Function>

Next, functions of the present exemplary embodiment will be described.

According to the image forming apparatus 10 in the present exemplary embodiment, the transported sheet P is held on the outer peripheral surface of the transfer body 36 from the gripping point 49 provided in the transport path A. At this time, the outer peripheral surface of the transfer body 36 is charged upstream of the holding point 48 in the rotation direction of the transfer body 36 by the charge unit 46. Therefore, a portion other than the leading end portion of the sheet P is held on the outer peripheral surface of the transfer body 36 by electrostatic attraction. Then, the sheet P is supplied to the secondary transfer unit 18 in a state of being held on the outer peripheral surface of the transfer body 36.

According to such a configuration, as compared with a configuration in which the sheet P is directly supplied to the secondary transfer unit without passing through the outer peripheral surface of the transfer body 36, a posture of the sheet P when passing through the secondary transfer unit 18 is stable. In a case in which a thickness of the sheet P is thin, wrinkles are likely to occur on the sheet P since the posture of the sheet P is generally biased to any axial direction in the secondary transfer unit 18. According to the configuration of the image forming apparatus 10 in the present exemplary embodiment, the posture of the sheet P is stabilized by the transfer body 36, and occurrence of wrinkles on the sheet P is prevented.

The voltage applied to the transfer body 36 by the charge unit 46 is a voltage having a polarity opposite to the voltage applied to the intermediate transfer belt 22 by the backup roll 33. Therefore, as compared with a configuration in which a voltage of the same polarity is applied by the charge unit 46 and the backup roll 33, an applied voltage required for the backup roll 33 for formation of an electric field in the secondary transfer unit 18 becomes low.

Before the sheet P to be transported is supplied to the secondary transfer unit 18, the leading end of the sheet P is held by the gripper 42 at the gripping point 49. Then, the sheet P to be transported is further transported in this state and is held on the outer peripheral surface of the transfer body 36 at the holding point 48. According to such a configuration, when the sheet P is held on the outer peripheral surface of the charged transfer body 36, the posture of the sheet P may be stabilized as compared with a configuration in which the leading end of the sheet P is not held by the gripper 42.

A position (holding point 48) at which the sheet P starts to be held on the transfer body 36 is provided upstream of the secondary transfer unit 18 and downstream of the charge unit 46 in the rotation direction of the outer peripheral surface of the transfer body 36. With such a configuration, the outer peripheral surface of the transfer body 36 is already charged by the charge unit 46 when the sheet P is supplied at the holding point 48.

More specifically, when the transfer body 36 is charged in a state in which the sheet P is held on the outer peripheral surface of the transfer body 36, it is necessary to charge the transfer body 36 via the sheet P or by avoiding the sheet P, and it is difficult to charge the surface of the transfer body 36. In particular, when the transfer body 36 is charged via the sheet P, depending on characteristics of the sheet P, a voltage necessary for charging the outer peripheral surface of the transfer body 36 may increase. In comparison with such a configuration, in the image forming apparatus 10 according to the present exemplary embodiment, since the outer peripheral surface of the transfer body 36 is charged without using the sheet P, the voltage applied to the charge unit 46 may be made lower.

Second Exemplary Embodiment

The image forming apparatus according to the second exemplary embodiment of the present disclosure will be described with reference to FIG. 1. Since the image forming apparatus according to the second exemplary embodiment is a modified example of the image forming apparatus according to the first exemplary embodiment, the same reference numerals are appropriately given to duplicated contents, and the explanation thereof will be omitted.

In the second exemplary embodiment, a transport path of a sheet is different from that according to the first exemplary embodiment. More specifically, the sheet P discharged from the sheet tray 38 is supplied to the transfer body 36 along a sheet transport path C shown in FIG. 1. At this time, the sheet P is held upstream of the charge unit 46 in a rotation direction of the transfer body 36 by the transfer body 36.

The sheet P supplied to the transfer body 36 is transported between the transfer body 36 and the charge unit 46 in accordance with the rotation of the transfer body 36. When the sheet P passes between the transfer body 36 and the charge unit 46, a voltage is applied by the charge unit 46. Accordingly, adhesion of the sheet P to the transfer body 36 is assisted.

At this time, the gripper 42 and the rotation path D pass between the transfer body 36 and the charge unit 46. Here, when the gripper 42 passes between the transfer body 36 and the charge unit 46, a voltage applied to the charge unit 46 is controlled by the control unit 16 so that a voltage is not applied to the gripper 42 by the control unit 46.

Further, the leading end of the sheet P is held on a surface of the transfer body 36 by the gripper 42.

<Function>

Hereinafter, functions of the image forming apparatus according to the second exemplary embodiment will be described.

According to the present exemplary embodiment, before the sheet P is transported to the secondary transfer unit 18, a voltage is applied to an image forming surface by the charge unit 46. Accordingly, a front surface of the sheet P is uniformly charged. Therefore, occurrence of image disturbance due to irregular charging of the front surface of the sheet P may be prevented.

The sheet transport path C according to the second exemplary embodiment may be applied only during printing of a back surface when double-sided printing of the sheet P is performed. In this case, the sheet P is transported between the transfer body 36 and the charge unit 46 only when the back surface is printed.

According to such a configuration, the front surface of the sheet P may have a history (=charging history) of the voltage applied in the secondary transfer unit 18 during printing the front surface, or a charge generated when the sheet P is peeled from a fixing roll in the fixing device 40. In such a case, an electrical history on the front surface of the sheet P may be erased by the voltage applied by the charge unit 46.

Third Exemplary Embodiment

The image forming apparatus according to the third exemplary embodiment of the present disclosure will be described with reference to FIGS. 3 to 5. Since the image forming apparatus according to the third exemplary embodiment is a modified example of the image forming apparatus according to an exemplary embodiment which is the first exemplary embodiment, the same reference numerals are appropriately given to duplicated contents, and the explanation thereof will be omitted.

In accordance with information acquired by the sensor 17 and the control unit 16, an absolute value of a voltage applied to the transfer body 36 by the charge unit 46 is changed by the control unit 16.

Figure 3:
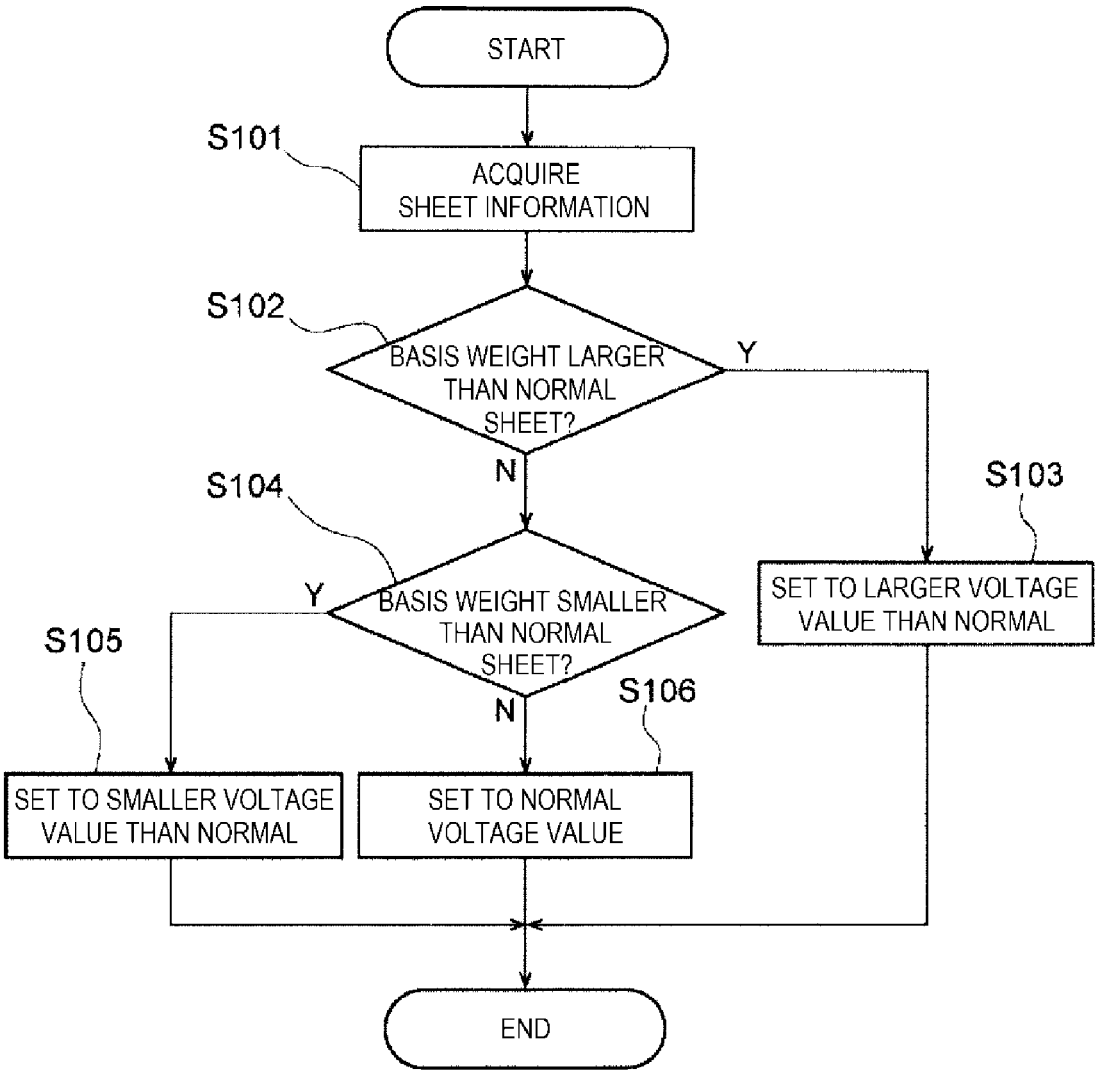
FIG. 3 is a flowchart showing an example of control processing of a charge unit according to a third exemplary embodiment.
Figure 4:
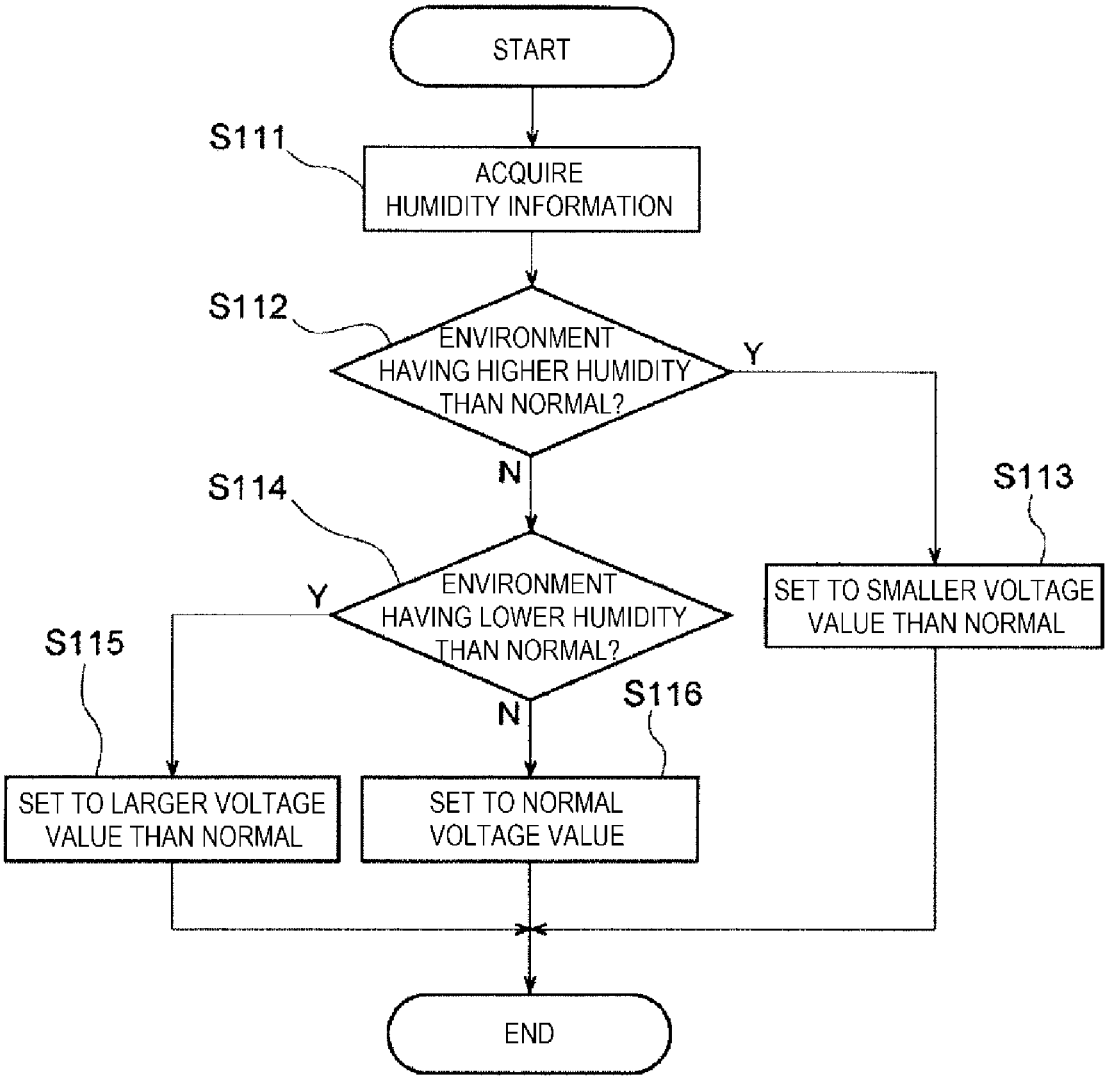
FIG. 4 is a flowchart showing an example of the control processing of the charge unit according to the third exemplary embodiment.
Figure 5:
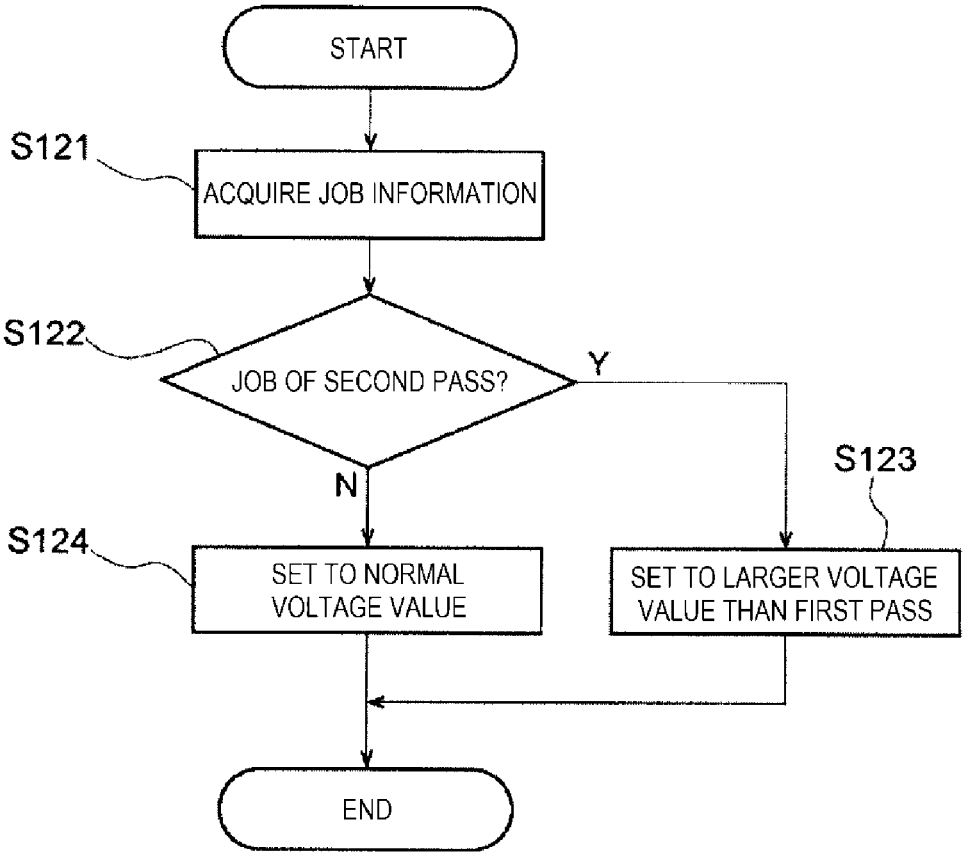
FIG. 5 is a flowchart showing an example of the control processing of the charge unit according to the third exemplary embodiment.

FIGS. 3 to 5 show an example of control processing in the image forming apparatus according to the third exemplary embodiment. Here, the control processing shown in these figures is executed by a CPU, a ROM, a storage, and a RAM (not shown) that are provided in the control unit 16. Specifically, the control processing is executed by loading a control program read from the ROM or the storage into the RAM by the CPU.

FIG. 3 shows control processing when a voltage value of a voltage applied by the charge unit 46 is changed according to a basis weight of the sheet P to be transported.

When the control processing is started, the sensor 17 acquires basis weight information of the sheet P (step S101). When the basis weight of the sheet acquired by the sensor 17 is larger than a reference value stored in advance in the control unit 16 (=step S102: YES), the control unit 16 controls a voltage applied to the transfer body 36 by the charge unit 46 so that the absolute value of the applied voltage becomes a larger voltage value (a larger voltage value than normal) as compared with a voltage value (a normal voltage value) when the sheet (normal sheet) having the basis weight of the reference value is printed (=step S103). The basis weight of the reference value referred to here may be, for example, the basis weight of the sheet expected to have the largest number of output opportunities.

On the other hand, when the basis weight of the sheet acquired by the sensor 17 is equal to or smaller than the reference value stored in advance in the control unit 16 (=step S102: NO), the processing proceeds to step S104.

Then, when the basis weight of the sheet acquired by the sensor 17 is smaller than the reference value stored in advance in the control unit 16 (=step S104: YES), the control unit 16 controls a voltage applied to the transfer body 36 by the charge unit 46 so that the absolute value of the applied voltage becomes a smaller voltage value (a smaller voltage value than normal) as compared with a voltage value (a normal voltage value) when the sheet having the basis weight of the reference value is printed (=step S105).

On the other hand, when the basis weight of the sheet acquired by the sensor 17 is equal to or larger than the reference value stored in advance in the control unit 16 (=step S104: NO), the control unit 16 controls a voltage applied to the transfer body 36 by the charge unit 46 so that the absolute value of the applied voltage becomes a predetermined reference value (=step S105).

FIG. 4 shows control processing when a voltage value of a voltage applied by the charge unit 46 is changed according to humidity of an environment in which the image forming apparatus 10 is used.

When the control processing is started, the sensor 17 acquires humidity information of the environment in which the image forming apparatus 10 is used (step S111). When the humidity acquired by the sensor 17 is higher than a reference value stored in advance in the control unit 16, it is determined that the environment is an "environment having higher humidity than normal" (=step S112: YES), and the control unit 16 controls a voltage applied to the transfer body 36 by the charge unit 46 so that the absolute value of the applied voltage becomes a small voltage value (a smaller voltage value than normal) as compared with the voltage value to be used at the humidity of a reference value (=step S113).

On the other hand, when the humidity of the environment in which the image forming apparatus 10 is used, which is acquired by the sensor 17, is equal to or lower than the reference value stored in advance in the control unit 16 (=step S112: NO), the processing proceeds to step S114.

Further, when the humidity of the environment in which the image forming apparatus 10 is used, which is acquired by the sensor 17, is lower than the reference value stored in advance in the control unit 16, it is determined that the environment is an "environment having lower humidity than normal" (=step S114: YES), and the control unit 16 controls a voltage applied to the transfer body 36 by the charge unit 46 so that the absolute value of the applied voltage becomes a large voltage value (a larger voltage value than normal) as compared with the voltage value to be used at the humidity of a reference value (=step S115).

On the other hand, when the basis weight of the sheet acquired by the sensor 17 is equal to or larger than the reference value stored in advance in the control unit 16 (=step S114: NO), the control unit 16 controls a voltage applied to the transfer body 36 by the charge unit 46 so that the absolute value of the applied voltage becomes a predetermined reference value (a normal voltage value) (=step S116).

FIG. 5 shows control processing of changing a voltage value of a voltage applied to the transfer body 36 by the charge unit 46 in accordance with whether the sheet P serving as an image formation target is thermally fixed by the fixing device 40 and then supplied to the transfer body 36. A case in which the sheet P referred to here is thermally fixed and then supplied to the transfer body 36 corresponds to, for example, a case in which printing (=a print job of a first pass) of the front surface is performed and then printing (=a print job of a second pass) of the back surface is performed when the double-sided printing is performed.

When the control processing is started, the control unit 16 acquires information of a print job (step S121). When the information of the print job acquired by the control unit 16 is a print job of a second pass (=step S122: YES), the control unit 16 controls a voltage applied to the transfer body 36 by the charge unit 46 so that the absolute value of the applied voltage becomes a larger voltage value (a larger voltage value than a first pass) as compared with a voltage value (a voltage value of a predetermined reference value) in a case of a print job of the first pass (=step S123).

On the other hand, when the information of the print job acquired by the control unit 16 is not the print job of the second pass (=step S122: NO), the processing proceeds to step S124.

When the information of the print job acquired by the control unit 16 is not the print job of the second pass (=step S122: NO), a voltage applied to the transfer body 36 by the charge unit 46 is controlled so that the absolute value of the applied voltage of the charge unit 46 becomes a voltage value (a normal voltage value) of a predetermined reference value (=step S124).

<Function>

Hereinafter, functions of the image forming apparatus according to the third exemplary embodiment will be described.

According to the present exemplary embodiment, as shown in FIG. 3, the absolute value of the voltage applied to the transfer body 36 by the charge unit 46 is changed according to the basis weight of the sheet P. When the basis weight of the sheet P is larger than the reference value, since a resistance value of the sheet is high, a larger transfer voltage (that is, formation of a stronger electric field) is required in the secondary transfer unit 18. According to the present exemplary embodiment, when printing is performed on a sheet having a larger basis weight than the reference value, the voltage applied to the transfer body 36 in the charge unit 46 is controlled at a constant voltage with a higher voltage value. Conversely, when printing is performed on a sheet having a smaller basis weight, the voltage applied to the transfer body 36 in the charge unit 46 is controlled at a constant voltage with a smaller voltage value.

As shown in FIG. 4, the voltage applied to the transfer body 36 by the charge unit 46 is changed according to the humidity of the environment in which the image forming apparatus is used. When the humidity is lower than the reference value, since a moisture content decreases and a resistance value of the sheet increases, a larger transfer voltage (that is, formation of a stronger electric field) is required in the secondary transfer unit 18. According to the present exemplary embodiment, in a case of being used in an environment having lower humidity than normal, the voltage applied to the transfer body 36 in the charge unit 46 is controlled at a constant voltage with a larger voltage value than that in the normal state. Conversely, in a case of being used in an environment having higher humidity than normal, the voltage applied to the transfer body 36 in the charge unit 46 is controlled at a constant voltage with a small voltage value.

As shown in FIG. 5, the voltage applied by the charge unit 46 is changed according to presence or absence of a fixing history of the sheet. When the sheet is thermally fixed in the fixing device 40, moisture contained in the sheet evaporates in a fixing process, the moisture content of the sheet decreases, and the resistance value of the sheet increases. Therefore, a larger transfer voltage (that is, formation of a stronger electric field) is required in the secondary transfer unit 18. According to the present exemplary embodiment, when a sheet having the fixing history is supplied to the transfer body 36, the voltage applied to the transfer body 36 in the charge unit 46 is controlled at a constant voltage with a larger voltage value. Conversely, when a sheet having no fixing history is supplied, the voltage applied to the transfer body 36 in the charge unit 46 is controlled at a constant voltage with a smaller voltage value.

According to the image forming apparatus 10 in the present exemplary embodiment, a voltage necessary for transfer is applied to the transfer body 36 by the charge unit 46 according to the humidity and the environment in which the image forming apparatus 10 is used, and the presence or absence of the fixing history of the sheet, so that a transfer failure in the secondary transfer unit 18 may be prevented. When the voltage required for the transfer is smaller, since a constant voltage control is performed with a smaller voltage value, application of an excessive voltage is prevented.

In the present exemplary embodiment, it is also possible to change the voltage value for controlling the voltage applied to the surface of the transfer body 36 by the charge unit 46 at a constant voltage according to other characteristics instead of the basis weight of the sheet P. The characteristics of the sheet referred to here may be, for example, a material of the sheet and a level of sheet resistance caused by presence or absence of coating.

Other Exemplary Embodiments

Although the image forming apparatus according to each exemplary embodiment has been described above, it is a matter of course that the image forming apparatus may be implemented in various forms without departing from the gist of the present disclosure.

For example, the charge unit 46 in each exemplary embodiment is exemplified as a roll-shaped contact charging device (=charge unit 46), but a charging method is not limited to this. For example, a non-contact discharge type charging device may be used. In this case, the gripper 42 may be rotated so as to pass between the transfer body 36 and the charging device.

Further, in each of the above exemplary embodiments, the gripper 42 is exemplified as a configuration in which the leading end of the sheet is physically held, but is not limited to such a structure. For example, the gripper 42 may hold the leading end of the sheet P by a force for suctioning air.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The invention claimed is:

1. An image forming apparatus, comprising:

an image holder configured to hold an image formed using an electrographic process;

a transfer body that faces the image holder and is configured to contact the image holder while rotating to form a secondary transfer region;

an application unit configured to apply a voltage for charging the secondary transfer region;

a charge unit that faces a region other than the secondary transfer region of the transfer body and is configured to charge a surface of the transfer body with a polarity opposite to the voltage for charging the secondary transfer region;

a gripper configured to hold an image formation target medium on the surface of the transfer body;

a holding point at which the gripper holds the medium onto which the image is to be transferred on the surface of the transfer body upstream of the secondary transfer region and downstream of the charge unit in a rotation direction in the transfer body; and a gripping point at which the gripper grips the medium upstream of the transfer body in a transport path of the medium, wherein the gripper rotates along a rotation path passing through the gripping point, the holding point, and the secondary transfer region, and the rotation path avoids a contact portion between the charge unit and the transfer body.

2. The image forming apparatus according to claim 1, wherein the charge unit is controlled at a constant voltage such that a voltage applied to the surface of the transfer body is constant.

3. The image forming apparatus according to claim 2, wherein an absolute value of the voltage applied to the surface of the transfer body by the charge unit is set according to characteristics of the image formation target medium.

4. The image forming apparatus according to claim 3, wherein an absolute value of a voltage applied by the charge unit when the image formation target medium is thermally fixed and then supplied to the transfer body is a value larger than an absolute value of a voltage applied by the charge unit when the medium is supplied to the transfer body without being thermally fixed.

5. The image forming apparatus according to claim 2, wherein an absolute value of the voltage applied to the surface of the transfer body by the charge unit is set according to humidity of an environment in which the image forming apparatus is used.

6. The image forming apparatus according to claim 5, wherein an absolute value of a voltage applied by the charge unit when the image formation target medium is thermally fixed and then supplied to the transfer body is a value larger than an absolute value of a voltage applied by the charge unit when the medium is supplied to the transfer body without being thermally fixed.

7. The image forming apparatus according to claim 1, wherein a perimeter of the transfer body is equal to or greater than a length in a transport direction of a medium having a longest length in the transport direction among media to be transported.

8. An image forming apparatus, comprising:

an image holder configured to hold an image formed using an electrographic process;

a transfer body that faces the image holder and is configured to contact the image holder while rotating to form a secondary transfer region;

an application unit configured to apply a voltage for charging the secondary transfer region; and a charge unit that faces a region other than the secondary transfer region of the transfer body and is configured to charge a surface of the transfer body with a polarity opposite to the voltage for charging the secondary transfer region, wherein an absolute value of a voltage applied to a region of the transfer body that comes into contact with an image that is held by the image holder and that is not transferred to an image formation target medium is smaller than an absolute value of a voltage applied when the image held by the image holder is transferred to the medium, an absolute value of a voltage applied to a region of the image holder for holding the image that is not transferred to the image formation target medium is smaller than the absolute value of the voltage applied when the image held by the image holder is transferred to the medium, and the region of the transfer body in which the voltage is applied by the charge unit is wider in a circumferential direction of the transfer body than the region of the image holder in which the voltage is applied by the application unit.

9. An image forming apparatus, comprising:

an image holder configured to hold an image formed using an electrographic process;

a transfer body that faces the image holder and is configured to contact the image holder while rotating to form a secondary transfer region;

an application unit configured to apply a voltage for charging the secondary transfer region; and a charge unit that faces a region other than the secondary transfer region of the transfer body and is configured to charge a surface of the transfer body with a polarity opposite to the voltage for charging the secondary transfer region, wherein an absolute value of a voltage applied to a region of the transfer body that comes into contact with an image that is held by the image holder and that is not transferred to an image formation target medium is smaller than an absolute value of a voltage applied when the image held by the image holder is transferred to the medium, and the transfer body is driven for one round in a state in which a voltage generated by the charge unit is not applied when a printing operation at a time of transferring the image held by the image holder to the medium is shifted to an operation of forming an image that is not transferred to the medium.

* * * * *